US009293080B2

(12) United States Patent
Kishi et al.

(10) Patent No.: US 9,293,080 B2
(45) Date of Patent: Mar. 22, 2016

(54) DATA LINE DRIVING CIRCUIT, DISPLAY DEVICE INCLUDING SAME, AND DATA LINE DRIVING METHOD

(71) Applicant: Sharp Kabushiki Kaisha, Osaka (JP)

(72) Inventors: Noritaka Kishi, Osaka (JP); Masanori Ohara, Osaka (JP); Noboru Noguchi, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

(21) Appl. No.: 14/429,302

(22) PCT Filed: Sep. 13, 2013

(86) PCT No.: PCT/JP2013/074813

§ 371 (c)(1),
(2) Date: Mar. 18, 2015

(87) PCT Pub. No.: WO2014/046029

PCT Pub. Date: Mar. 27, 2014

(65) Prior Publication Data

US 2015/0248856 A1 Sep. 3, 2015

(30) Foreign Application Priority Data

Sep. 19, 2012 (JP) ..... 2012-205461

(51) Int. Cl.
*G09G 5/00* (2006.01)
*G09G 3/30* (2006.01)
*G09G 3/32* (2006.01)

(52) U.S. Cl.
CPC ..... *G09G 3/30* (2013.01); *G09G 3/3208* (2013.01); *G09G 3/3291* (2013.01); *G09G 3/3233* (2013.01); *G09G 2300/0819* (2013.01); *G09G 2300/0842* (2013.01); *G09G 2300/0861* (2013.01); *G09G 2320/045* (2013.01); *G09G 2330/021* (2013.01)

(58) Field of Classification Search
CPC ..... G09G 3/3233; G09G 3/3291; G09G 2300/0819; G09G 2330/021; G09G 2300/0861; G09G 2320/045; G09G 3/30; G09G 2300/0842; G09G 3/3208
USPC ..... 345/76–83, 90–98, 204–215
See application file for complete search history.

(56) References Cited

U.S. PATENT DOCUMENTS

| | | | | |
|---|---|---|---|---|
| 8,305,303 | B2 * | 11/2012 | Nam | 345/76 |
| 8,462,086 | B2 * | 6/2013 | Takasugi et al. | 345/78 |
| 9,047,815 | B2 * | 6/2015 | Kimura | |
| 2005/0017934 | A1 | 1/2005 | Chung et al. | |
| 2007/0200804 | A1 | 8/2007 | Kwon | |

FOREIGN PATENT DOCUMENTS

| | | | |
|---|---|---|---|
| JP | 2005-31630 | A | 2/2005 |
| JP | 2007-233326 | A | 9/2007 |

* cited by examiner

*Primary Examiner* — Vijay Shankar
(74) *Attorney, Agent, or Firm* — Chen Yoshimura LLP

(57) ABSTRACT

A detection output circuit provided in a source driver compares a voltage detected by a resistor and a voltage of a driving signal using comparators drives a transistor, a capacitor and an operational amplifier using a ramp signal so that they are maintained at voltages corresponding to a current flowing through a data line, and performs feedback control so that the potential of the data line is a desired potential. With this simple configuration, a data line circuit can be achieved that is capable of eliminating variation in driving transistor characteristics and the like, while performing current protection at high speed.

11 Claims, 8 Drawing Sheets

DATA LINE DRIVING CIRCUIT, DISPLAY DEVICE INCLUDING SAME, AND DATA LINE DRIVING METHOD

TECHNICAL FIELD

The present invention relates to a data line driving circuit, a display device including the same, and a data line driving method. More specifically, the present invention relates to a data line driving circuit for driving a pixel circuit including organic electro-luminescence (EL) devices, a display device including the same and a driving method for the same.

BACKGROUND ART

An organic EL display device is well-known as a thin-screen, high-definition display device with low power consumption. An organic EL display device contains a plurality of pixel circuits arranged in a matrix, each pixel circuit including an organic EL element formed by a light-emitting electro-optic element that is driven by an electric current, a driving transistor and the like.

Methods for controlling an amount of current flowing in current-driven display devices such as organic EL elements can be broadly classified as being either constant current control methods (or current program-type driving methods) whereby the current to flow in the display device is controlled using a data signal current flowing in the data signal line electrode of the display device, or constant voltage control methods (or voltage program-type driving methods) whereby the current to flow in the display device is controlled using a voltage dependent on a data signal voltage. When display is performed with an organic EL display device using the constant voltage control method, it is necessary to compensate for variations in threshold voltage and mobility of the driving transistors, which are typically thin-film transistors (hereinafter abbreviated to "TFTs"), and for current reductions (loss of brightness) that occur as the resistance of the organic EL elements increases due to degradation over time. On the other hand, when the constant current control method is used, it not generally necessary to perform the above-described compensation because the data signal current value is controlled so that a fixed current flows in the organic EL element irrespective of the above-described threshold voltage or internal resistance of the organic EL element. However, it is common knowledge that when the constant current control method is used, the number of driving transistors and amount of wiring are higher than when the constant voltage control method used, thus reducing the aperture ratio. Also, since the data signal current is weak, it is not possible to rapidly write data using the charge on the data signal line electrodes or the like.

In configurations employing the constant voltage control method, there are various conventional configurations for the pixel circuit that performs the above-described compensation. For example, Japanese Patent Application Laid-Open Publication No. 2005-31630 discloses an organic EL display device in which compensation for variation in the threshold voltage is performed by providing a transistor for detecting fluctuation of the threshold voltage of the driving transistors in the pixel circuit. Note that in the following, compensation for variation in the threshold voltage is also referred to as "threshold voltage compensation". Further, Japanese Patent Application Laid-Open Publication No. 2007-233326 discloses an organic EL display device in which compensation for variation in the transistor characteristics, and variation (deviation) in mobility in particular, is performed by detecting the driving current flowing in the driving transistor and controlling the voltage supplied to the data line in accordance with the detection results.

RELATED ART DOCUMENTS

Patent Documents

Patent Document 1: Japanese Patent Application Laid-Open Publication No. 2005-31630

Patent Document 2: Japanese Patent Application Laid-Open Publication No. 2007-233326

SUMMARY OF THE INVENTION

Problems to be Solved by the Invention

The conventional organic EL display device described above allows precise compensation of threshold voltage or the like. However, the display device described in Japanese Patent Application Laid-Open Publication No. 2005-31630 requires that a transistor be added within the pixel circuit for performing threshold voltage compensation, thus complicating the configuration of the pixel circuit.

Moreover, the display device described in Japanese Patent Application Laid-Open Publication No. 2007-233326 needs wiring to feed back the current flowing in the pixel circuit. As a result, that the aperture ratio may be reduced, signal rounding (detection delays) may occur due to wiring resistance and parasitic capacitance, and signal noise (detection errors) may occur due to leakage currents from the non-selected pixel circuits to the wiring. In recent years, in particular, detections delays have become more problematic due the rapid driving demanded for display devices of higher resolutions.

It is therefore the objective of the present invention to provide a display device including a data line driving circuit capable of eliminating variation in driving transistor characteristics while detecting current at high speed with a simple configuration, and without the addition of transistors within the pixel circuit or signal wiring, and to supply a data line driving method for the same.

Means for Solving the Problem

Aspect 1 of the present invention is a data line driving circuit configured to be included in an active matrix-type display device having a plurality of pixel circuits arranged in a matrix, the data line driving circuit including:

a driving signal generating circuit that receives from outside an image signal representing an image to be displayed, and outputs a driving signal corresponding to the image signal;

an output circuit configured to be connected, via a connection node, to a data line connected to at least one of the plurality of pixel circuits in the active matrix-type display device so as to drive the data line;

a current detecting and controlling circuit configured to be connected to the data line via the connection node, the current detecting and controlling circuit detecting a current flowing in the data line, and comparing the detected current in the data line with a target value that is determined in accordance with the driving signal, the current detecting and controlling circuit receiving a ramp signal having a voltage monotonically increasing from a minimum possible value for the driving signal to a maximum possible value for the driving signal, and supplying the ramp signal to the output circuit until a substantial match is found in the comparison so that the ramp signal is provided to the data line from the output circuit until then, the current detecting and controlling circuit maintaining a voltage of the ramp signal that was reached when the substantial match is found in the comparison and supplying the maintained voltage of the ramp signal to the output circuit so that the maintained voltage is provided to the data line.

Aspect 2 of the present invention is Aspect 1 of the present invention, wherein the current detecting and controlling circuit includes:

a current detection circuit configured to be connected to the data line via the connection node, the current detection circuit having an output node opposite to the connection node such that a potential difference between the output node and the connection node corresponds to the current flowing in the data line;

an operation circuit that receives a voltage value at the output node and an inverse of a voltage value representing the driving signal, and outputs a difference value of the two values;

a comparing circuit that compares the difference value that is output from the operation circuit with a voltage value at the connection node; and a switch circuit that makes an electrical connection such that, until a substantial match is found between the two voltage values being compared by the comparing circuit, the ramp signal is supplied to the output circuit.

Aspect 3 of the present invention is Aspect 1 of the present invention, wherein the current detecting and controlling circuit includes:

a current detection circuit configured to be connected to the data line via the connection node, the current detection circuit having an output node opposite to the connection node such that a potential difference between the output node and the connection node corresponds to the current flowing in the data line;

an operation circuit that receives a voltage value at the connection node and a voltage value representing the driving signal, and outputs a difference value of the two values;

a comparing circuit that compares a voltage value at the output node of the current detection circuit with the difference value that is output from the operation circuit; and a switch circuit that makes an electrical connection such that, until a substantial match is found between the two voltage values compared by the comparing circuit, the ramp signal is supplied to the output circuit.

Aspect 4 of the present invention is Aspect 1 of the present invention, wherein the output circuit includes an operational amplifier that receives the ramp signal supplied by the current detecting and controlling circuit at a non-inverting input terminal of the operational amplifier, wherein the current detecting and controlling circuit includes a current detection circuit that includes a resistor with one end thereof connected to an inverting input terminal of the operational amplifier of the output circuit and the other end connected to an output terminal of the operational amplifier, and wherein the operational amplifier and the resistor form a transimpedance circuit.

Aspect 5 of the present invention is Aspect 1 of the present invention, wherein the current detecting and controlling circuit includes a variable resistance circuit that receives a portion or all of bits of a digital signal representing the driving signal so as to set a resistance thereof in accordance therewith, and wherein the current detecting and controlling circuit compares a potential difference across the variable resistance circuit with a predetermined reference voltage in the case that the variable resistance circuit receives all of bits of the digital signal or with a reference voltage that is set within a predetermined range in accordance with remaining bits of the digital signal in the case that the variable resistance circuit receives the portion of bits of the digital signal, so as to compare the detected current with the target value determined by the driving signal, and supplies the ramp signal to the output circuit until a substantial match is found in the comparison.

Aspect 6 of the present invention is Aspect 5 of the present invention, wherein the variable resistance circuit receives a prescribed range of high-order bits forming the portion of the digital signal representing the driving signal to set the resistance thereof in accordance with the high-order bit data, and wherein the current detecting and controlling circuit receives low-order bit data that form a remaining portion of bits of the digital signal, and sets the reference voltage in accordance with the low-order bit data of the digital signal, the current detecting and controlling circuit comparing the reference voltage with the potential difference across the variable resistance circuit, so as to compare the detected current in the data line with the target value determined by the driving signal, supplies the ramp signal to the output circuit until a substantial match is found in the comparison.

Aspect 7 of the present invention is Aspect 1 of the present invention, wherein the current detecting and controlling circuit includes a transistor circuit including a transistor operating in a linear region, one end of the transistor circuit being a drain terminal, the other end being a source terminal, and a set voltage that is a predetermined value or that is variable within a predetermined range being supplied to a gate terminal.

Aspect 8 of the present invention is Aspect 7 of the present invention, wherein the transistor circuit receives a portion or all of bits of a digital signal representing the driving signal, and the set voltage to be supplied to the gate terminal is determined in accordance with the portion of or all bits of the digital signal so that a resistance of the transistor between the drain terminal and the source terminal depends on the portion or all of bits of the digital signal, the transistor circuit thereby functioning as a variable resistance circuit, and wherein the current detecting and controlling circuit comparing a potential difference across the transistor circuit with a predetermined reference voltage in the case that the transistor circuit receives all of bits of the digital signal or with a reference voltage that is set in accordance with remaining bits of the digital signal in the case that the transistor circuit receives the portion of bits of the digital signal, and supplies the ramp signal to the output circuit until a substantial match is found in the comparison.

Aspect 9 of the present invention is an active-matrix type display device that includes:

a display unit that includes a plurality of data lines, a plurality of scan lines, and a plurality of pixel circuits arranged in correspondence with the plurality of data lines and the plurality of scan lines;

the data line driving circuit according to claim 1 connected to the plurality of data lines; and scan line driving circuits connected to the plurality of scan lines, wherein the pixel circuit includes an electro-optic element driven by an electric current and a driving transistor that is provided in series with the electro-optic element and controls a driving current to be supplied to the electro-optic element in accordance with a voltage supplied via the data line.

Aspect 10 of the present invention is Aspect 9 of the present invention, wherein the driving transistor is a thin-film transistor having a channel layer formed by an oxide semiconductor, and wherein the oxide semiconductor has indium, gallium or zinc as a main component.

Aspect 11 of the present invention is a method of driving a data line provided for an active matrix-type display device having a plurality of pixel circuits arranged in a matrix, the method including:

generating a driving signal by receiving from outside an image signal representing an image to be displayed and outputting a driving signal corresponding to the image signal;

outputting, to a data line connected to at least one of the plurality of pixel circuits, a ramp signal having a voltage value monotonically increasing from a minimum possible level for the driving signal to a maximum possible level for the driving signal;

detecting a potential difference corresponding to a current flowing in the data line;

comparing a voltage value corresponding to the detected potential difference with a voltage value of the driving signal; and allowing the ramp signal to continue to be outputted to the data line in the step of outputting until a substantial match is found in the step of comparing, and when the substantial match is found in the step of comparing, maintaining a voltage of the ramp signal that was reached when the substantial match is found, and outputting the maintained voltage to the data line instead of the ramp signal thereafter.

Effects of the Invention

According to Aspect 1 of the present invention, a voltage value corresponding to a potential difference detected by the current detecting circuit is compared with a voltage value of the driving signal, the ramp signal is supplied to the output circuit until a substantial match is achieved, and, on achievement of the substantial match, control is performed to continue to supply to the output circuit the voltage of the ramp signal at the moment of the substantial match. Hence, with a simple configuration, and without the addition of transistors within the pixel circuit 11 or signal wiring, it is possible eliminate or at least suppress variation in driving transistor characteristics and the like while rapidly detecting current.

According to Aspect 2 of the present invention, a control circuit with a simple configuration including an operation circuit, a comparing circuit, and a switch circuit makes it possible to eliminate or at least suppress variation in driving transistor characteristics and the like.

According to Aspect 3 of the present invention, the difference value between the voltage value supplied to the input terminal of the current detecting circuit and the voltage value of the driving signal is calculated by the operation circuit. Hence, the voltage value of the driving signal can be set to a value of 0 or higher, typically to an appropriate range with a magnitude of a few volts.

According to Aspect 4 of the present invention, a transimpedance circuit is configured by the operational amplifier and a resistor. Hence, a frequency band is very wide and the circuit is capable of rapid operation. Specifically, when operating the data lines of high-resolution display units, this circuit can operate without causing delays.

According to Aspect 5 of the present invention, the resistance value changes in accordance with the voltage value of the driving signal to be supplied to the data line. Typically, the resistance value decreases as the voltage value increases, and the time to write to the data line can be shortened as the gradation value increases. Moreover, since the comparison-use voltage does not become a voltage signal having large amplitude in the manner of the driving signal, power consumption can be kept low.

According to Aspect 6 of the present invention, it is possible to keep power consumption low by reducing the amplitude of the comparison-use voltage while using a simpler construction and reducing the variable range of the resistance value.

According Aspect 7 of the present invention, it is possible to realize similar functionality to a resistive element using a transistor operating in the linear range. Hence, a large resistance value can be realized with a small circuit area.

According to Aspect 8 of the present invention, a simple configuration for controlling the gate voltage of the transistor makes it possible to reduce writing time to the data line without, for example, switching between a large number of resistors. In addition, the amplitude of the comparison-use voltage is small, thereby reducing power consumption.

According Aspect 9 of the present invention, similar effects to Aspect 1 of the present invention can be realized in a display device.

According to Aspect 10 of the present invention, an IGZO-TFT is employed as the driving transistor. Hence, the effects of signal noise resulting from OFF current leaking from the unselected pixel circuits can be substantially ignored, and highly accurate current detection is possible.

According Aspect 11 of the present invention, similar effects to Aspect 1 of the present invention can be realized using a data line driving method.

DETAILED DESCRIPTION OF EMBODIMENTS

Embodiments 1 to 4 of the present invention will be explained below with reference to the attached drawings. In the following, m and n are integers of 2 or higher, i is an integer not lower than 1 and not higher than n, and j is an integer not lower than 1 and not higher than m. Note that in a channel layer of the transistors included in the pixel circuits of the embodiments, an oxide semiconductor with a relatively high mobility, specifically an oxide semiconductor containing at least one of indium (In), gallium (Ga) or zinc (Zn), or InGaZnOx (referred to hereinafter as "IGZO") that is an oxide semiconductor containing these as main components, is used. TFTs using IGZO (hereinafter referred to as IGZO-TFTs) are well-known for having an extremely small OFF current. Hence, the effects of signal noise resulting from OFF current leaking from the unselected pixel circuits can be substantially ignored. Note, however, that another well-known semiconductor material such as low temperature polysilicon or amorphous silicon may be used in the transistor channel layer.

1. Embodiment 1

1.1 Overall Configuration

Figure 1:
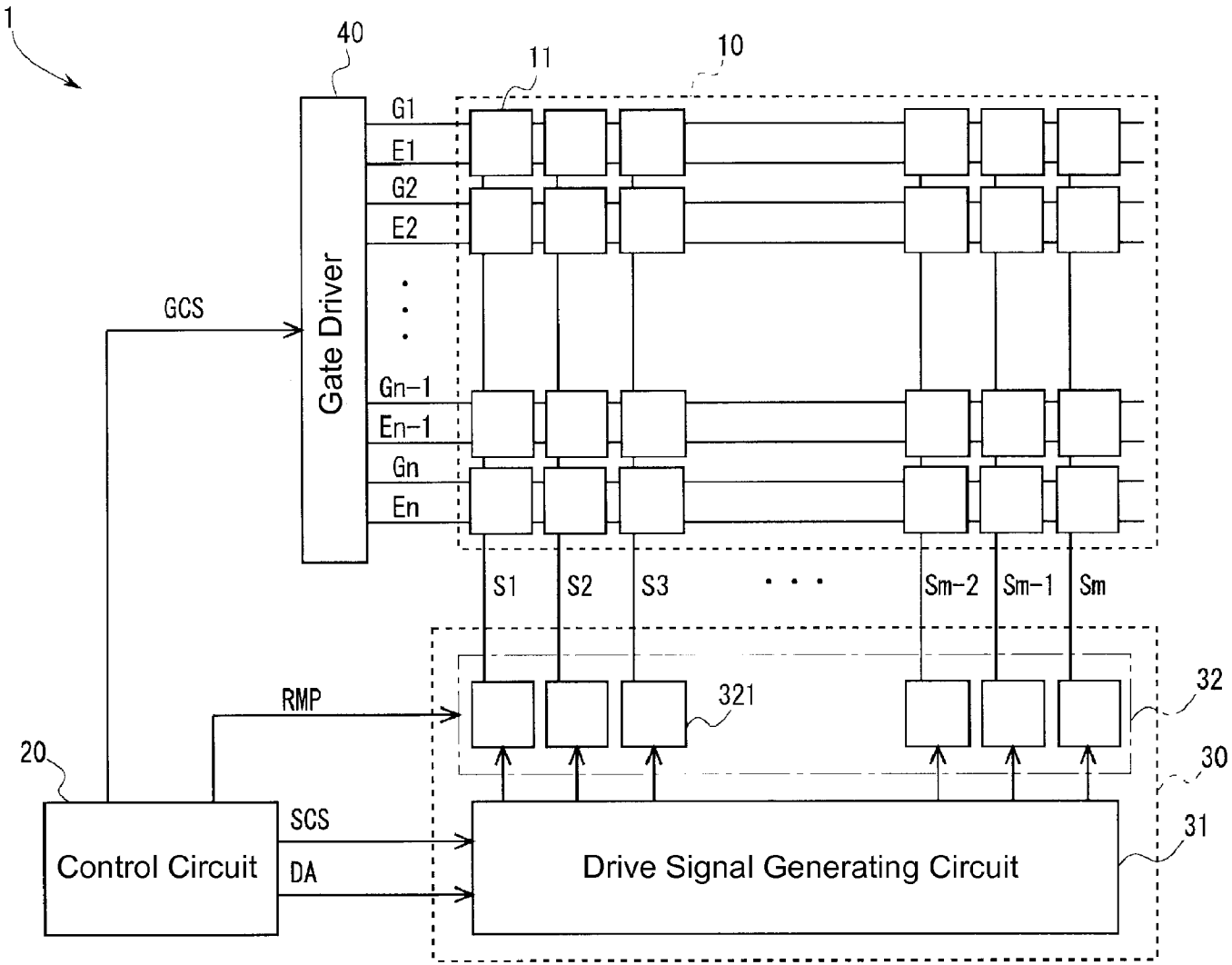
FIG. 1 is a block diagram showing a configuration of an organic EL display device according to Embodiment 1 of the present invention.

FIG. 1 is a block diagram showing a configuration of an active matrix type organic EL display device 1 according to Embodiment 1 of the present invention. The organic EL display device 1 includes a display unit 10, a control circuit 20, a source driver (data driver) 30 and a gate driver (scan driver) 40. In the present embodiment, the source driver 30 corresponds to the data line driving circuit and the gate driver 40 corresponds to the scan line driving circuit. At least one of the source driver 30 and the gate driver 40 may be integrally (monolithically) formed with the glass substrate that forms the display unit 10.

The display unit 10 has disposed therein m data lines S1 to Sm and n scan lines G1 to Gn perpendicular to the m data lines S1 to Sm. The display unit 10 further includes n light emission control lines E1 to En arranged along the n scan lines G1 to Gn. The display unit 10 is further provided with m×n pixel circuits 11 at points of intersection between the m data lines S1 to Sm and the n scan lines G1 to Gn. Note also that the pixel circuits 11 are formed so that a red, green and blue sub-pixel arrangement is repeated in the stated order as one moves along an extension direction of the scan lines from the side of the gate driver 40.

Further, the display unit 10 is further provided with m power supply lines that supply a power supply voltage Vp from a power supply unit (not shown in the drawings) (hereinafter, the power supply lines are denoted by the reference character Vp, which is the same reference character used to denote the power supply voltage, or, for the 1 to mth power supply lines respectively, by Vp1 to Vpm), and common electrodes that supply a common potential Vcom (hereinafter the common electrodes are denoted by the reference character Vcom, which is the same reference characters used to denote the common potential). The power supply lines Vp1 to Vpm are arranged parallel to and in one-to-one correspondence with the data lines S1 to Sm, and the common electrodes Vcom are commonly provided for all the pixel circuits. Provided that a well-known configuration is used, there are no particular limits on the arrangement direction or arrangement scheme of the power supply lines. While in this case, the power supply voltage Vp is a fixed voltage, the power supply voltage may vary between prescribed values according to a pixel circuit arrangement, or a configuration including a plurality of different kinds of power supply lines may be used.

The control circuit 20 controls the source driver 30 and the gate driver 40 by supplying video data DA, a source controlling signal SCS and a later-described ramp signal RMP to the source driver 30, and a gate controlling signal GCS to the gate driver 40. The source controlling signal SCS includes, for example, a source start pulse, a source clock, and a latch strobe signal. The gate controlling signal GCS includes, for example, a gate start pulse and a gate clock.

The source driver 30 is connected to the m data lines S1 to Sm, and includes a driving signal generating circuit 31 and a detection/output unit 32. The driving signal generating circuit 31 includes an m-stage shift register not shown in the drawings, and m sampling circuits, latch circuits, D/A converters, buffer circuits and the like. The m driving signal generating circuits 31 are provided in one-to-one correspondence with the m data lines S1 to Sm, and output a driving signal to each. The detection/output unit 32 includes m detection/output circuits 321. The m detection/output circuits 321 are provided in one-to-one correspondence with the m data lines S1 to Sm, detect the currents flowing in each, and output voltage signals such that currents suitable for the driving signals flow (i.e. corrected voltage signals). The detection/output circuit 321 is described in more detail in a later section.

The driving signal generating circuit 31 has a configuration, not shown in the drawings, that is similar to other well-known source drivers. In other words, the driving signal generating circuit 31 includes a shift register, sampling circuit, latch circuit, D/A converter, and the like. The shift registers of the driving signal generating circuit 31 sequentially output a sampling pulse by sequentially shifting the source start pulse in synchronization with the source clock. The sampling circuit sequentially stores a rows-worth of video data DA in accordance with the timing of the sampling pulse. The latch circuit receives and retains the rows-worth of the video data DA stored by the sampling circuit in accordance with the latch strobe signal, and 1 columns-worth (that is, 1 sub-pixels-worth) of video data DA (hereinafter referred to as "gradation data" is supplied to the corresponding D/A converter. The D/A converters convert the received gradation data to data voltages, and supply the data voltages representing the gradation data to the corresponding detection/output unit 32 (via buffer circuits). Thus, the driving signal generating circuit 31 supplies m columns-worth of data voltages to the m data lines S1 to Sm connected to the detection/output circuits 321 based on the video data DA and the source controlling signal SCS. Note that, as will be described in a later section, the symbol of voltage Vdt (>0) of the driving signal is reversed so as to be supplied to the detection/output circuits 321 as a driving signal with the voltage value −Vdt.

The gate driver 40 is connected to n scan lines G1 to Gn and n emission control lines E1 to En, and drives these accordingly. More specifically, the gate driver 40 includes similar main elements to other well-known gate drivers, including shift registers, logic circuits and the like that are not shown in the drawings. The signals to be supplied to the n-scan lines G1 to Gn and the signals to the n emission control lines E1 to En are generated using the shift register that sequentially shifts the gate start pulse in synchronization with the gate clock and logic circuits supplied with outputs from stages of the shift register. Note that the gate driver 40 may drive only the n scan lines G1 to Gn and the emission control lines E1 to En may be driven by a separate emission control-use gate driver.

1.2 Pixel Circuit and Detection/Output Circuit

Figure 2:
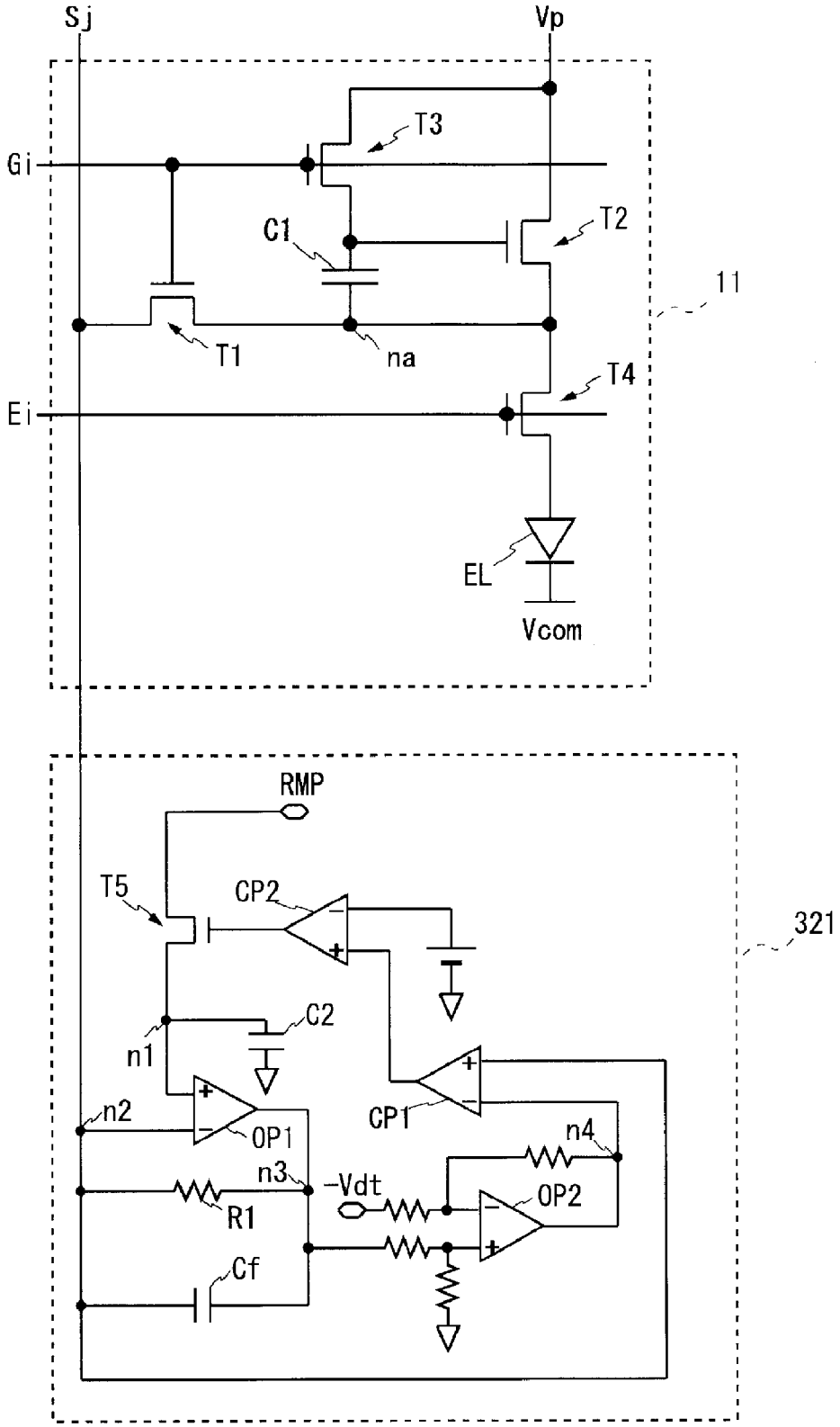
FIG. 2 is a circuit diagram showing a configuration of a pixel circuit and detection/output circuit according to Embodiment 1.

FIG. 2 is a circuit diagram showing a configuration of the pixel circuit 11 and the detection/output circuit 321 according to Embodiment 1. The pixel circuit 11 shown in FIG. 2 is the pixel circuit 11 of the ith row and the jth column. Further, the detection/output circuit 321 shown in FIG. 2 is the data line Sj of the jth column.

The pixel circuit 11 includes one organic EL element EL, four transistors T1 to T4, and one capacitor C1. The transistors T1 and T3 function as write controlling transistors, transistor T2 functions as a driving transistor, and transistor T4 functions as an emission controlling transistor. The capacitor C1 corresponds to a driving capacitive device. The transistors T1 to T4 are all n-channel IGZO-TFTs. Note, however, that the same effects can be obtained provided that at least transistor T2 is an IGZO-TFT. Note also that the above configurations and functions of the transistor are but one example, and various other well-known pixel circuit configurations can be appropriately applied.

The transistor T2 is provided in series with the organic EL element EL with a drain terminal connected as a first conducting terminal to a power supply line Vp (here, a power supply line Vpj). A gate terminal of transistor T1 is connected to the scan line Gi (the gate terminal corresponds to the controlling terminal, and the gate terminals of other transistors are similarly connected). The transistor T1 is provided between a source terminal, which is a second conducting terminal, of transistor T2 and the data line Sj. The transistor T3 is provided between the gate terminal and the drain terminal of the transistor T2, and a gate terminal of the transistor T3 is connected to the scan line Gi. The transistor T4 is provided between the source terminal of the transistor T2 and an anode terminal of the organic EL element EL, and a gate terminal of the transistor T4 is connected to the emission control line Ei.

The capacitor C1 is connected to a source terminal of the transistor T2 at one end and to the gate terminal of the transistor T2 at the other. A cathode terminal of the organic EL element is connected to the common electrode Vcom. In the following description relating to the present embodiment, a connection point of the source terminal of the transistor T2, one end of the capacitor C1, the transistor T1 conducting terminal positioned on the source terminal side of the transistor T2, and the transistor T4 conducting terminal positioned on the source terminal side of the transistor T2 is referred to, for convenience, as "node na".

The detection/output circuit 321 includes two operational amplifiers OP1 and OP2, two comparators CP1 and CP2, one transistor T5, two capacitors C2 and Cf, and a plurality of resistors including resistor R1. The resistor R1 functions as the current detecting circuit, the operational amplifier OP2 including a plurality of resistors functions as the operation circuit, the two comparators CP1 and CP2 function as the comparing circuit, the transistor T5 functions as the switch circuit, and the capacitor C2 and operational amplifier OP1 function as the output circuit. Further, the operation circuit, the comparing circuit and the switch circuit function as the controller that controls output of a (consequently corrected) data signal from the output circuit to the data line Sj. Here, the controller and the current detecting circuit described above are together collectively referred to as the "current detecting and controlling circuit" throughout this disclosure. Similarly, the operational amplifier OP1 and the resistor R1 (together with the capacitor Cf) configure a transimpedance circuit. This is described in more detail in a later section.

The resistor R1 has one end connected to the data line Sj and another end to the output terminal of the operational amplifier OP1. In the following, the former of these connection points is, for convenience, referred to as "node n2", and the latter, where appropriate, as "node n3". Further, the resistor R1 is connected in parallel with the capacitor Cf to prevent oscillation. The operational amplifier OP2 has the non-inverting input terminal connected (via a resistor) to the other end of the resistor R1 (which is to say node n3). Supplied to this inverting input terminal from the driving signal generating circuit 31 (via a resistor) is the voltage value −Vdt. The inverting input terminal and the output terminal of the operational amplifier OP2 are connected via a resistor, and the output terminal of the operational amplifier OP2 is connected to an inverting input terminal of the comparator CP1. For convenience, this connection point is referred to as "node n4". Note also that the non-inverting input terminal of the operational amplifier OP2 is grounded via a resistor (that is connected here to the common electrode Vcom or a prescribed ground potential). The non-inverting input terminal of the comparator CP1 is connected to the data line Sj, and the output terminal of the comparator CP1 is connected to the non-inverting input terminal of the comparator CP2. The inverting input terminal of the comparator CP2 is connected to the power supply of prescribed voltage, and the output terminal of the comparator CP2 is connected to the gate terminal of the transistor T5 (controlling terminal). The drain terminal (first conducting terminal) of the transistor T5 is supplied with the later-described ramp signal RMP, and the source terminal of the transistor T5 (second conducting terminal) is connected to the non-inverting input terminal of the operational amplifier OP1. For convenience, this connection point is referred to as "node n1". Further, the non-inverting input terminal (which is to say node n1) is connected to one end of the capacitor C2, the other end of the capacitor C2 being connected to ground in a similar manner to the ground connection described above. The inverting input terminal of the operational amplifier OP1 is connected to the data line Sj. Operation of the detection/output circuit 321 described above will now be explained.

1.3 Operation of Detection/Output Circuit

The detection/output circuit 321, as previously described, receives the ramp signal RMP from the control circuit 20. The ramp signal RMP is a sawtooth wave, that changes, within a single horizontal period (1H), between the common potential Vcom (or a prescribed lowest potential) and a voltage corresponding to a maximum gradation voltage (or a prescribed highest potential), and, at the start of the next horizontal period (or immediately before the start) changes to the common potential Vcom (or the lowest potential). The sawtooth waveform described here is just one example of the ramp signal RMP, and the signal can take any form with a monotonic increase over a single horizontal period. Note, however, that a signal waveform in which rate of change of voltage is constant or largely unchanging allows the later-described operations to be performed with greater accuracy. Note also that the mode of change of the ramp signal RMP may be the opposite of that described (that is, monotonically decreasing). The detection/output circuit 321 performs current feedback so that a potential of the data line Sj is at a desired potential through use of the current detecting circuit (resistor R1) and the changing of the ramp signal RMP.

First, the resistor R1 functions as a detecting circuit for detecting a current flowing in the data line Sj. Specifically, since input impedances of the operational amplifier OP1 and the comparator CP1 are very high, the current flowing in the data line Sj can be substantially accurately detected by detecting the current i flowing in resistor R1.

When a voltage at node n2 at one end of the resistor R1 is denoted Vn2, a voltage at node n3 at the other end of the resistor R1 is denoted Vn3, a resistance of the resistor R1 is denoted R, and a current flowing in the resistor R1 is denoted i, the relationship of the following Equation (1) holds.

$$Vn3=Vn2-R\cdot i \quad (1)$$

Thus, when a voltage at the node n4 is denoted Vn4, due to the operation of the operational amplifier OP2 that functions as the operation circuit, a voltage Vn4 can be represented, working from Equation (1), as shown in Equation (2) below.

$$Vn4=Vn2-R\cdot i+Vdt \quad (2)$$

Since the voltage Vn4 is supplied to the inverting input terminal of the comparator CP1, and the voltage Vn2 is supplied to the non-inverting input terminal of the comparator CP1, the output voltage from the comparator CP1 is low when $R\cdot i<Vdt$ and high when $R\cdot i\geq Vdt$. Consequently, when $R\cdot i<Vdt$, the output voltage of the comparator CP2 is similarly low, and the transistor T5 is turned OFF. Conversely, when $R\cdot i\geq Vdt$, the output voltage of the comparator CP2 is high, and the transistor T5 is turned ON.

Here, when a gradation voltage starts to be applied to the data line Sj, a large current flows, and so (because $R\cdot i\geq Vdt$) the transistor T5 is turned ON. Hence, in this case, when the voltage of the ramp signal is denoted Vrmp, the voltage at node n1 is denoted Vn1 and the voltage at node n2 is denoted Vn2, these voltages can be represented as in Equation (3) below, and the ramp signal is applied to the data signal line Sj.

$$Vrmp=Vn1=Vn2 \quad (3)$$

Thereafter, the ramp signal voltage Vrmp remains high for one horizontal period and the current i flowing in the data signal line Sj continues to drop, and, at the point that $R\cdot i=Vdt$ (since the output voltage of the comparator CP2 goes low) the transistor T5 turns OFF. At this time, the potential of the voltage Vn1 at the node n1 is maintained by the capacitor C2. Thus, the voltage Vn2 is also maintained at the inverting input terminal (that is, node n2) of the operational amplifier OP1 that functions as an output unit, and, as a result, the potential of the data line Sj is maintained until the transistor T5 turns on again.

Thus, a current i corresponding to the voltage Vdt of the driving signal flows in the data line Sj. As a result, even when the driving signal is directly applied to the data line Sj and the current originally designed to flow (ideal current) differs from the current that actually flows (due to variation in the characteristics of the driving transistor or the like), it is possible, by detecting the current i actually flowing using the resistor R1 that functions as the current detecting circuit, to ensure that the current i actually flowing matches the current i originally intended to flow.

The current feedback control performed in the manner described above to ensure that the current i actually flowing matches the originally intended current is performed in a very short time within the single horizontal period. Thus, in the case of a high resolution display device in which the period is reduced to 10 μs or shorter, response speeds in configurations in which the voltage corresponding to a potential difference based on the current detected in a simple resistor is compared with the voltage of the driving signal are insufficient. Thus, control is either not possible or extremely difficult to achieve.

However, the present embodiment is configured by a transimpedance circuit including the operational amplifier OP1, the resistor R1 and the oscillation prevention capacitor Cf. Due to the use of the operational amplifier OP1, this transimpedance circuit can operate fast over wide frequency band. Thus, providing that the operational amplifier OP1 is one that operates sufficiently fast, it is possible to perform feedback control within a period of 10 μs or less so that a tiny current of 1 μA or fewer flows in the data line Sj.

Note that if one horizontal period is extremely short in the manner described and the rate of change of the voltage of the ramp signal RMP is extremely high at certain locations, the accuracy of the feedback control as such locations can be adversely affected. It is preferable, therefore, that the rate of change of the voltage be constant in the manner of an ideal ramp signal. Under such conditions, stable and highly accurate feedback control can be performed irrespective of the voltage values.

When the data line Sj voltage set as described above is received, the organic EL element EL in the pixel circuit will emit light of the desired brightness. The operation of the pixel circuit 11 is substantially the same as the operation of well-known pixel circuits (when threshold detection and threshold compensation operations are not performed). Hence, in the following, an example of this operation is briefly explained.

1.4 Operation of Pixel Circuit

In the pixel circuit 11, the voltage applied to the data line Sj is determined in accordance with the currently actually flowing, which depends on a threshold voltage, mobility and the like of the transistor T2. As a result, it is not necessary to perform threshold detection to maintain the threshold voltage of the transistor T2 on the capacitor C1. Since initialization operations are similar to those of well-known pixel circuits, the explanations of such operations have been omitted.

First, in a selection period, when the selection period of a first row starts, a potential of the first scan line G1 goes high, and so the transistors T1 and T3 in the pixel circuits 11 of the first line turn ON. At this time, a data voltage is written to the pixel circuit 11. However, as described above, when the driving signal is applied within the one horizontal period, the data voltage will be the ramp signal voltage Vrmp until the current actually flowing matches the current originally intended to flow.

When the selection period of the first row ends, the potential of the first scan line G1 goes low, and so the transistors T1 and T3 in the pixel circuits 11 of the first line turn OFF. As a result, the gate-source voltage held by the capacitor C1 is set at the above-described voltage maintained by the detection/output circuit 321. Thereafter, the above-described voltages corresponding to the data voltages are written to the pixel circuits 11 of each line by sequentially selecting (setting to high) the scan lines G2 to Gn of the 2nd to nth row in each selection period (each scan period).

Next, when the emission operation period arrives, the potentials of the emission control lines E1 to En of the 1st to nth row go high, and the transistor T4 turns ON in the pixel circuits 11 of the 1st to nth rows. Hence, the anode terminal of the organic EL element EL and the drain terminal of the transistor T2 are electrically connected to each other. As a result, the transistor T2 supplies the driving current Ioled to the organic EL element EL. Since the driving current Ioled is set according to the current actually flowing in the transistor T2, the above-described voltage corresponding to data voltage written to the pixel circuit 11 is set in advance to a value that takes into account characteristics such as the actual threshold voltage and mobility of transistor T2. Hence, the driving current Ioled is not affected by variation in characteristics such as the threshold voltage and the mobility of the transistor T2. Thus, it is possible to eliminate or at least suppress variations in brightness caused by variation in the above-described characteristics.

1.5 Effects of Embodiment 1

According to the present embodiment, with a simple configuration that adds n detection/output circuits 321 to the source driver 30 but does not add transistors within the pixel circuits 11, signal wiring for feedback control, or the like, it is possible to eliminate or at least suppress variation in driving transistor characteristics and the like while performing current detection at high speed.

Specifically, the present embodiment is configured by a transimpedance circuit including the operational amplifier OP1, the resistor R1 and the oscillation prevention capacitor Cf, thereby enabling operation at high speed over a very wide band of frequencies.

Further, in the present embodiment, IGZO-TFTs are employed as the transistors. Hence, the effects of signal noise resulting from OFF current leaking from the unselected pixel circuits can be substantially ignored, and highly accurate current detection is possible.

Moreover, according to the present embodiment, there is no need for threshold detection operations. Hence, the operation of the organic EL display device can be simplified to achieve an increase in the speed of operation.

1.6 Modification Example of Embodiment 1

Figure 3:
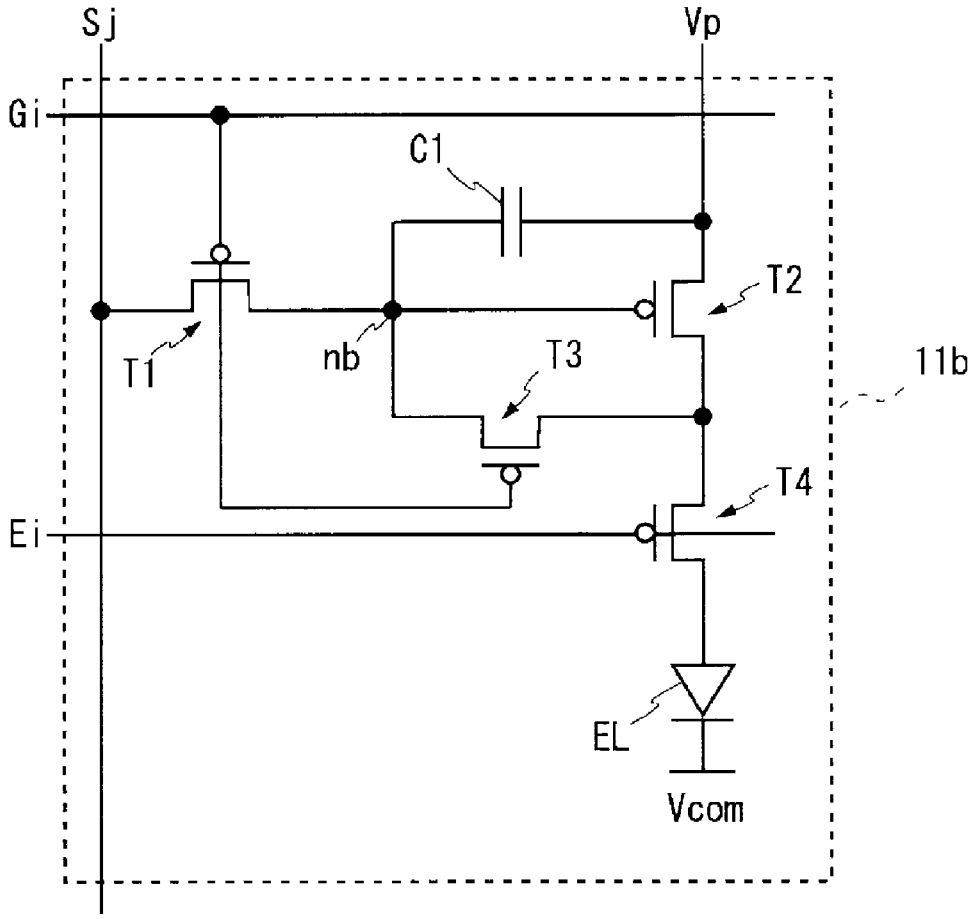
FIG. 3 is a circuit diagram showing a configuration of a pixel circuit according to a Modification Example of Embodiment 1.

FIG. 3 is a circuit diagram showing a configuration of a pixel circuit 11*b* according to Embodiment 1. Of the elements configuring the Modification Example, those identical to or resembling elements of Embodiment 1 are denoted using the same reference characters, and repetitious description is omitted. The pixel circuit 11*b* shown in FIG. 3 is the pixel circuit 11 of the ith row and the jth column. Note that the configuration of the detection/output circuit 321 according to the Modification Example is the same as that of Embodiment 1.

The pixel circuit 11*b* includes one organic EL element EL, four transistors T1 to T4, and one capacitor C1. Here, however, the transistors T1 to T4 differ from those of Embodiment 1 in all being p-channel transistors, such as low temperature polysilicon TFTs or amorphous silicon TFTs. The transistors T1 to T4 may also be oxide TFTs such as IGZO-TFTs.

The transistor T2 is provided in series with the organic EL element EL with a source terminal connected as a first conducting terminal to the power supply line Vp. The transistor T1 is provided between the gate terminal of the transistor T2 and the data line Sj, and a gate terminal of the transistor T1 is connected to the scan line Gi. The transistor T3 is provided between the drain terminal of the transistor T2, which forms the second conducting terminal, and the gate terminal of the transistor T2, and a gate terminal of the transistor T3 is connected to the scan line Gi. The transistor T4 is provided between the drain terminal of the transistor T2 and the anode terminal of the organic EL element EL, and a gate terminal of the transistor T4 is connected to the emission control line Ei. The capacitor C1 is connected to a source terminal of the transistor T2 at one end and to the gate terminal of the transistor T2 at the other. A cathode terminal of the organic EL element is connected to the common electrode Vcom. In the Modification Example, the node na described in Embodiment 1 corresponds to a connection point of the gate terminal of the transistor T2, one end of the capacitor C1, the transistor T1 conducting terminal positioned on the gate terminal side of the transistor T2, and the transistor T3 conducting terminal positioned on the gate terminal side of the transistor T2. For convenience, this connection point is referred to as "node nb".

Operation of the pixel circuit 11*b* and the detection/output circuit 321 of the Modification Example is basically the same as that of Embodiment 1 except in that, because the transistors T1, T3, and T4 are p-channel transistors, the potentials of the scan lines and emission control lines are the reverse of the potentials of Embodiment 1. Thus, the scan lines of the Modification Example are selectable when low. Moreover, due to the difference in the installed location of the capacitor C1, the holding voltage set in correspondence with the display gradation differs, and the capacitor C1 is charged by the gate-source voltage of the transistor T2. In other respects, the operation is basically the same as Embodiment 1, and so further explanation has been omitted.

Hence, similar effects to Embodiment 1 can be obtained with the organic EL display device 1 including the pixel circuits 11*b* configured using the one organic EL element EL, four p-channel transistors T1 to T4, and one capacitor C1 as in the present Modification Example.

2. Embodiment 2

Figure 4:
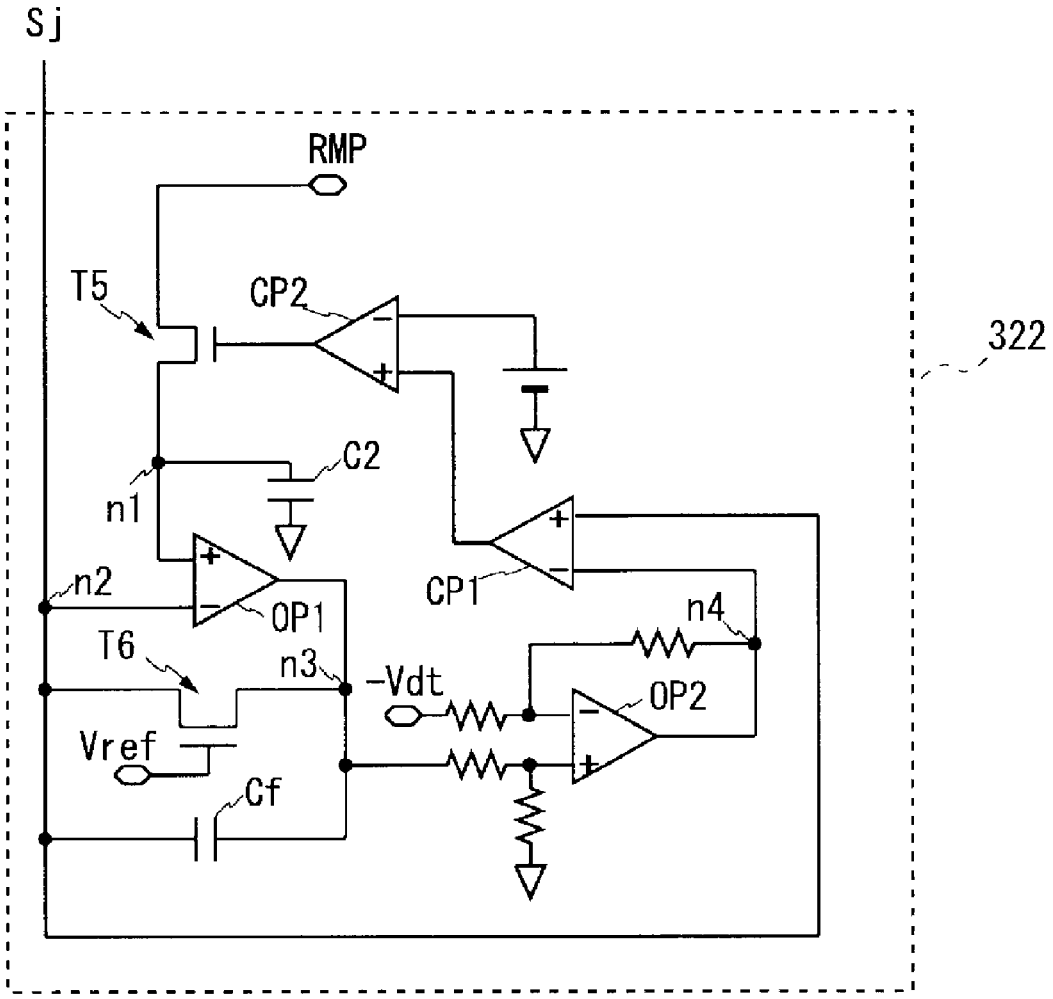
FIG. 4 is a circuit diagram showing a configuration of a detection/output circuit according to Embodiment 2 of the present invention.

Except in part of the configuration of a detection/output circuit 322 illustrated in FIG. 4, Embodiment 2 of the present invention provides a similar configuration and operations to Embodiment 1. Hence, elements identical to elements of Embodiment 1 are denoted using the same reference characters, and repetitious description is omitted.

FIG. 4 is a circuit diagram showing a configuration of a detection/output circuit 322 according to Embodiment 2 of the present invention. Here, the detection/output circuit 322 shown in FIG. 4, as in Embodiment 1, corresponds to the data line Sj of the jth column.

The detection/output circuit 322 shown in FIG. 4 has substantially the same configuration as the detection/output circuit 321 of Embodiment 1, but differs in that the resistor R1 functioning as the current detecting circuit included in the detection/output circuit 321 is replaced with a transistor T6 that functions as a current detecting circuit in the same way. The following described the function and operation of the transistor T6.

As illustrated in FIG. 4, The drain terminal of the transistor T6, which forms a first conducting terminal, is connected to the data signal line Sj (that is, node n2), and the source terminal of the transistor T6, which forms the second conducting terminal, is connected to the output terminal of the operational amplifier OP1 (that is, node n3). Further, the gate terminal (controlling terminal) of the transistor T6 is supplied with a set voltage Vref from an external portion. The set voltage Vref is appropriately set (set to a sufficiently high level) to ensure that the transistor T6 is operating in the linear region. For example, such a voltage may be supplied by the control circuit 20. When caused to operate in the linear region in this way, transistors are well-known to behave as a resistor between the gate and source terminals. The resistance value can be changed using the gate voltage, making it easy to realize a high resistance value.

Specifically, when the current to flow in the data line Sj is set to be a few nanoamperes, the resistance to function as the current detection device must be set to at least a few megaohms. Forming a resistor having such a large resistance on a glass substrate would require a large area, thus inhibiting miniaturization of the device. However, with the above-described transistor T6, it is possible to realize the above described large resistance while occupying a small area. Also, since the resistance value can be changed using the set voltage Vref, an appropriate resistance can easily be set. Moreover, a configuration in which the load introduced by current detection is reduced in the manner of later-described Embodiment 4 can be easily realized. This configuration is described in a later section as a Modification Example of Embodiment 4.

According to the present embodiment described above, a current detecting circuit having a large resistance while occupying a small area can be easily configured by using the transistor T6 operating in the linear region. Also, since the gate potential can be freely set, it is easy to set an appropriate resistance.

3. Embodiment 3

3.1 Configuration of Detection/Output Circuit

Figure 5:
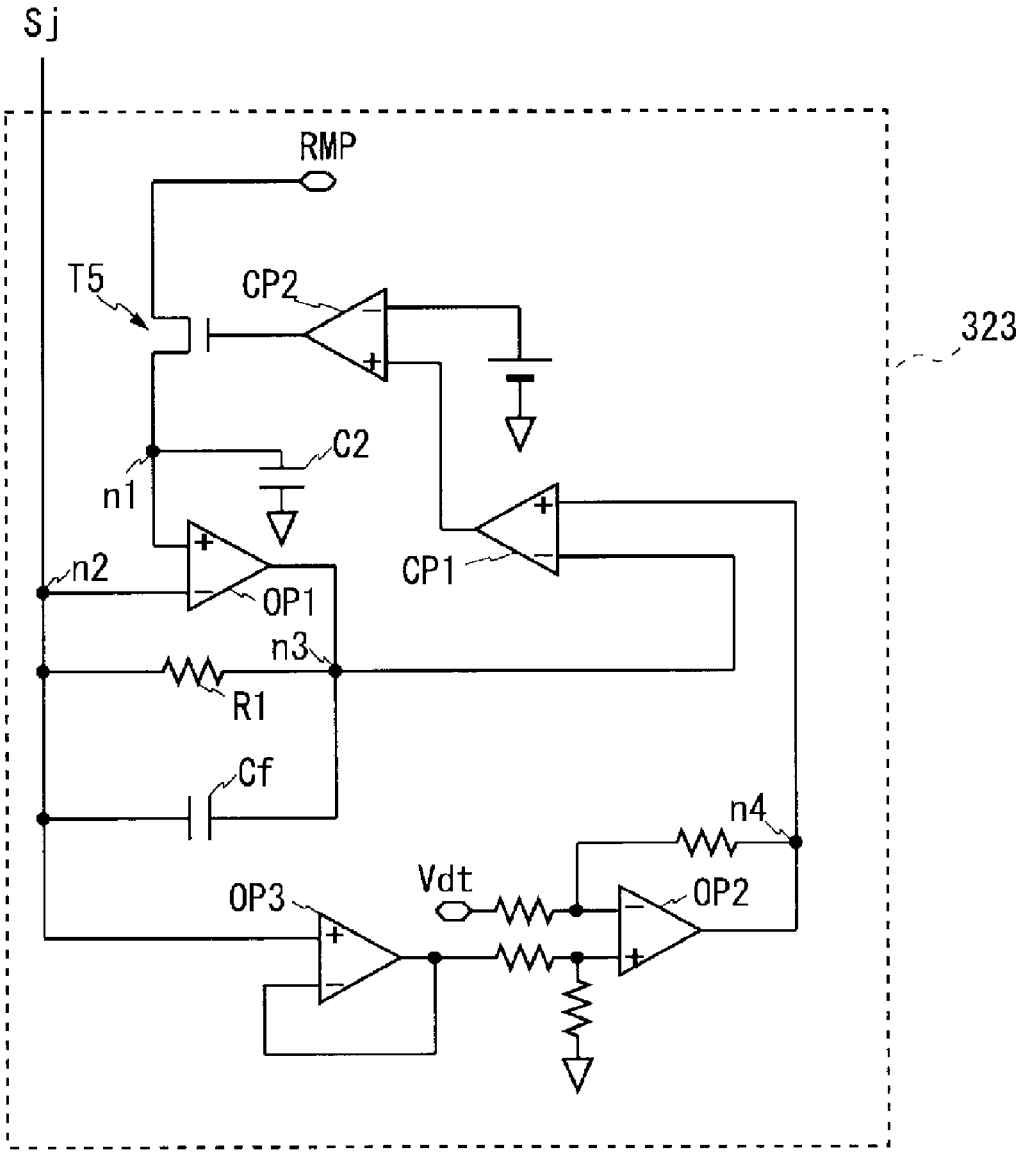
FIG. 5 is a circuit diagram showing a configuration of a detection/output circuit according to Embodiment 3 of the present invention.

In Embodiment 3 of the present invention, the elements of a detection/output circuit 323 illustrated in FIG. 5 have substantially the same configuration as Embodiment 1, but differ slightly in the interconnections. Further, the operation of the elements is substantially the same as Embodiment 1. Thus, the elements that are identical to or resemble elements of Embodiment 1 are denoted using the same reference characters, and repetitious description is omitted.

FIG. 5 is a circuit diagram showing a configuration of a detection/output circuit 323 according to Embodiment 3 of the present invention. Here, the detection/output circuit 323 shown in FIG. 5, as in the case of Embodiment 1, corresponds to the data line Sj of the jth column.

The detection/output circuit 323 shown in FIG. 5 has substantially the same configuration as the detection/output circuit 321 of Embodiment 1, but differs in the new inclusion of an operational amplifier OP3 that functions as a buffer circuit. The output terminal of the operational amplifier OP2 (node n4) is not connected to the inverting input terminal of the comparator CP1 in the manner of Embodiment 1, but is instead connected to the non-inverting input terminal of the comparator CP1. Further, the inverting input terminal of the comparator CP1 is not connected to the data line Sj as in Embodiment 1, but is instead connected to the output terminal of the operational amplifier OP1 (node n3).

Moreover, the non-inverting input terminal of the operational amplifier OP2 is connected to the data line Sj via the operational amplifier OP3. Specifically, the non-inverting input terminal of the operational amplifier OP3 is connected to a data line Sj. The inverting input terminal of the operational amplifier OP3 is connected to the output terminal of the same, and to the non-inverting input terminal of the operational amplifier OP2 via a resistor. Further, the inverting input terminal of the operational amplifier OP2 is supplied not with the voltage value −Vdt from the driving signal generating circuit 31, but instead supplied (via the resistor) with the driving signal of the voltage value Vdt.

Thus, according to the operation of the operational amplifier OP2 that functions as the operation circuit, the voltage Vn4 at the node n4 can be represented as shown in Equation (4) below.

$$Vn4=Vn2-Vdt \tag{4}$$

Since the voltage Vn4 is supplied to the non-inverting input terminal of the comparator CP1, and, from Equation (1) above, Vn2−R·i is supplied to the inverting input terminal of the comparator CP1, the output voltage from the comparator CP1 is, as in Embodiment 1, low when R·i<Vdt and high when R·i≥Vdt. Consequently, when R·i<Vdt, the output voltage of the comparator CP2 is similarly low, and the transistor T5 is turned OFF. Conversely, when R·i≥Vdt, the output voltage of the comparator CP2 is high, and the transistor T5 is turned ON.

Thus, according to the configuration of the present embodiment, the voltage value Vdt of the driving signal can be set to approximately 0 to 5V, or in the range of a few volts. As a result, there is no need to generate the voltage value −Vdt, and the amplitude of the data signal can be set in an appropriate range.

3.2 Modification Example of Embodiment 3

In the above-described Embodiment 3 of the present invention, the elements of the detection/output circuit 323 illustrated in FIG. 5 had differed slightly from Embodiment 1 in the connections between the elements. The present modification, on the other hand, includes the same elements as Embodiment 3, and differs only in the connection relationships between the elements. Thus, identical elements are denoted using the same reference characters, and repetitious description is omitted.

Figure 6:
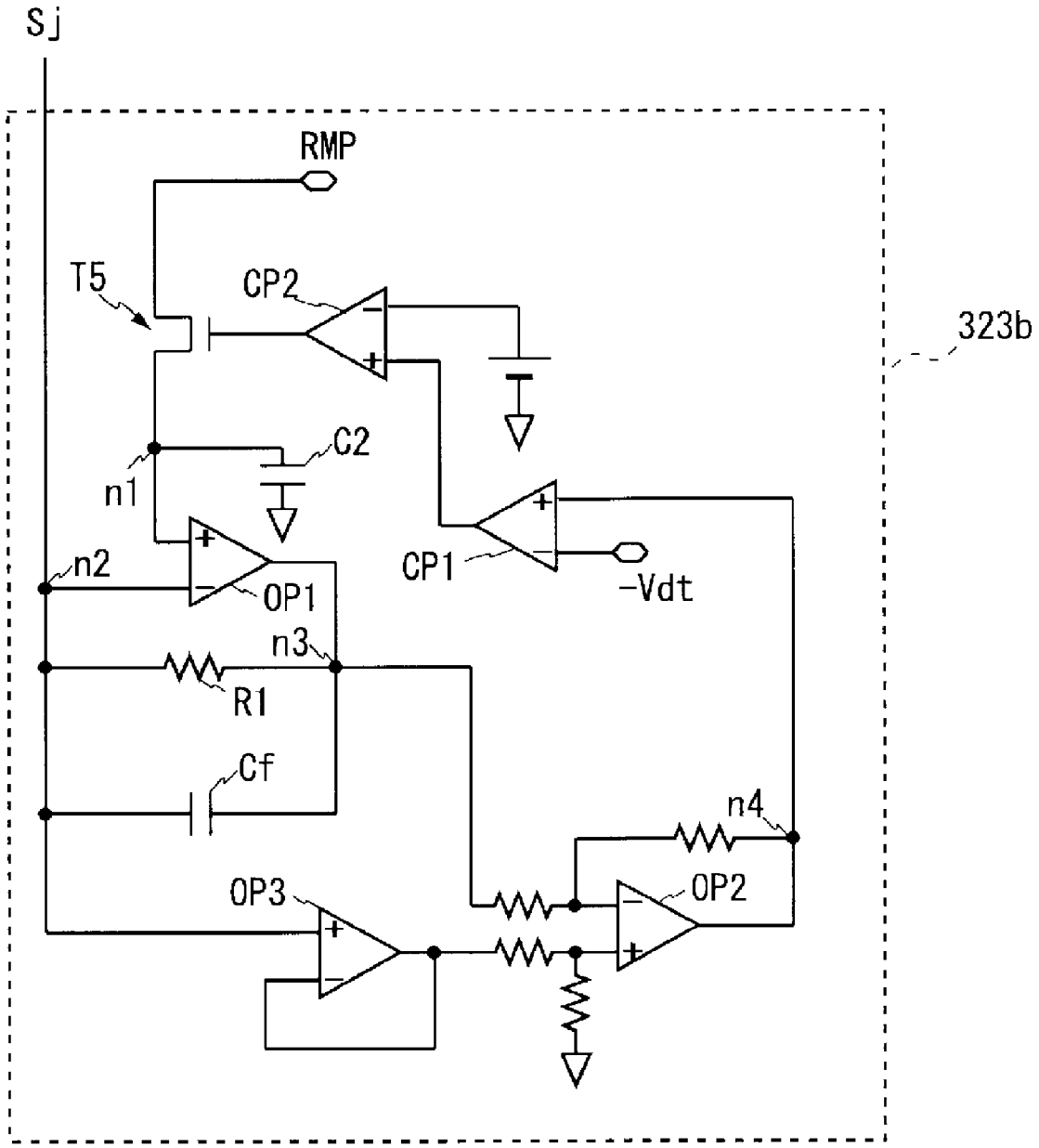
FIG. 6 is a circuit diagram showing a configuration of a detection/output circuit according to a Modification Example of Embodiment 3.

FIG. 6 is a circuit diagram showing a configuration of a detection/output circuit 323*b* according to Embodiment 3 of the present invention. Here, the detection/output circuit 323*b* shown in FIG. 6, as in the case of Embodiment 3, corresponds to the data line Sj of the jth column.

The detection/output circuit 323*b* shown in FIG. 6 has substantially the same configuration as the detection/output circuit 323 of Embodiment 3. However, the inverting input terminal of the operational amplifier OP2 is connected to the output terminal of the operational amplifier OP1 (node n3) via the resistor, and the inverting input terminal of the comparator CP1 is supplied with a voltage value −Vdt, which is the result of inverting the voltage value Vdt of the driving signal generating circuit 31.

Thus, according to the operation of the operational amplifier OP2 that functions as the operation circuit, the voltage Vn4 at the node n4 can, with reference to Equation (1), be represented as shown in Equation (5) below.

$$Vn4=Vn2-(Vn2-R\cdot i) \tag{5}$$

Since the voltage Vn4 is supplied to the non-inverting input terminal of the comparator CP1 and voltage value-Vdt is supplied to the inverting input terminal of the comparator CP1, the output voltage from the comparator CP1 is, as in Embodiment 1, low when R·i<Vdt and high when R·i≥Vdt. Consequently, when R·i<Vdt, the output voltage of the comparator CP2 is similarly low, and the transistor T5 is turned OFF. Conversely, when R·i≥Vdt, the output voltage of the comparator CP2 is high, and the transistor T5 is turned ON.

Thus, according to the present Modification Example, the same effects as Embodiment 1 can be obtained. Note also that in the above-described embodiments and the present embodiment, the signals input to the respective input terminals of the operational amplifier OP2 and the comparators CP1 and CP2 may be swapped between the inverting input terminal and the non-inverting input terminal. Various circuits may also be applied.

4. Embodiment 4

4.1 Configuration of Detection/Output Circuit

Figure 7:
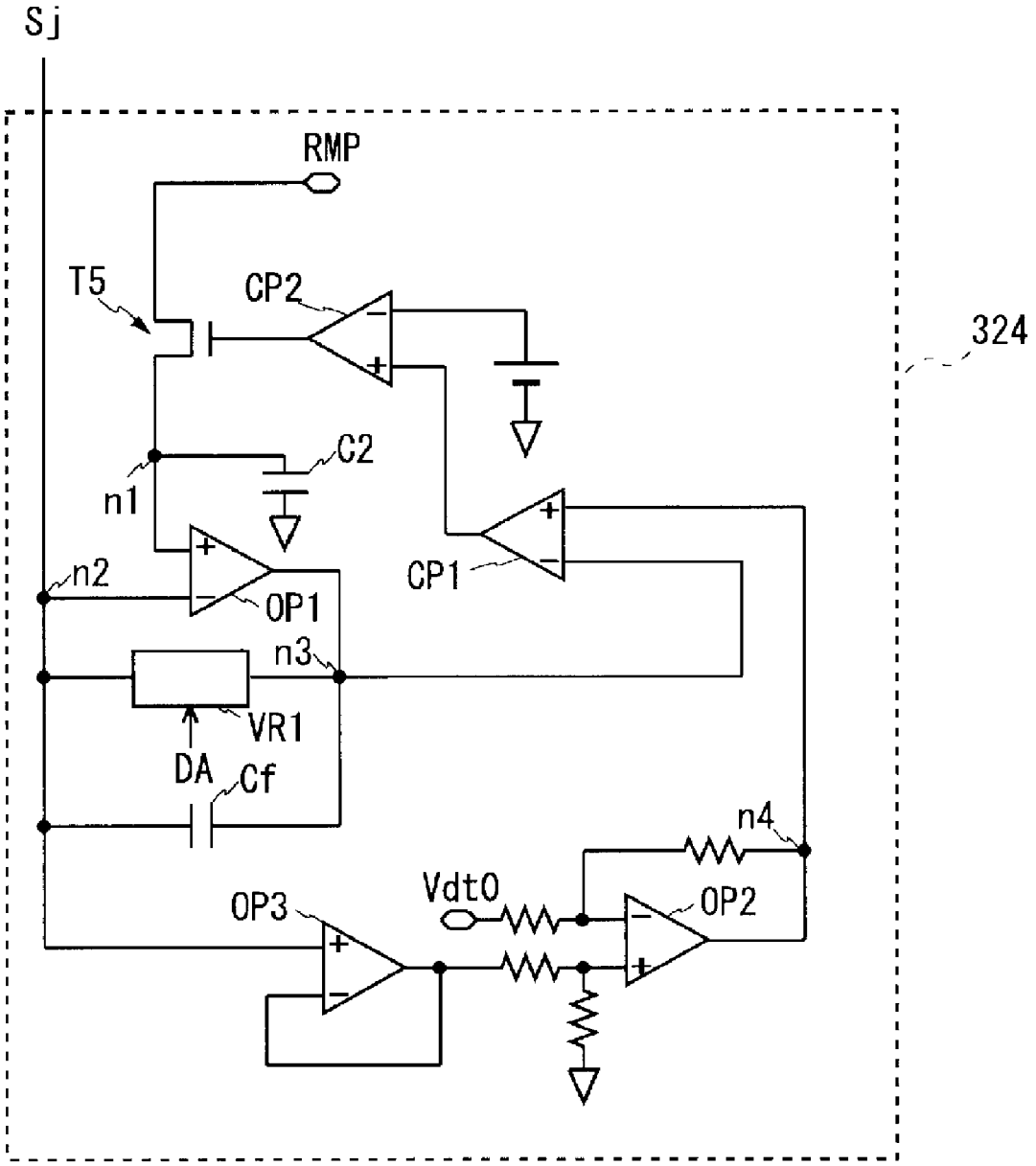
FIG. 7 is a circuit diagram showing a configuration of a detection/output circuit according to Embodiment 4 of the present invention.

Except in part of the configuration of a detection/output circuit 324 illustrated in FIG. 7, the detection/output circuit 324 of Embodiment 4 of the present invention provides a similar configuration and operations to Embodiment 1.

Hence, elements identical to the elements of Embodiment 1 are denoted using the same reference characters, and repetitious description is omitted.

FIG. 7 is a circuit diagram showing a configuration of a detection/output circuit 324 according to Embodiment 4 of the present invention. Here, the detection/output circuit 324 shown in FIG. 7, as in the case of Embodiment 1, corresponds to the data line Sj of the jth column.

The detection/output circuit 324 shown in FIG. 7 has substantially the same configuration as the detection/output circuit 321 of Embodiment 1, but differs in that the resistor R1 functioning as the current detecting circuit included in the detection/output circuit 321 is replaced with a variable resistance circuit VR1 that functions as a current detecting circuit in the same way. As illustrated in FIG. 7, the variable resistance circuit VR1 is connected in the same way as the resistor R1, but differs in that the resistance value can be changed. The resistance value is set in accordance with the video data DA that is digital data supplied from the control circuit 20. The following describes the configuration and operation of the variable resistance circuit VR1 with reference to FIG. 8.

Figure 8:
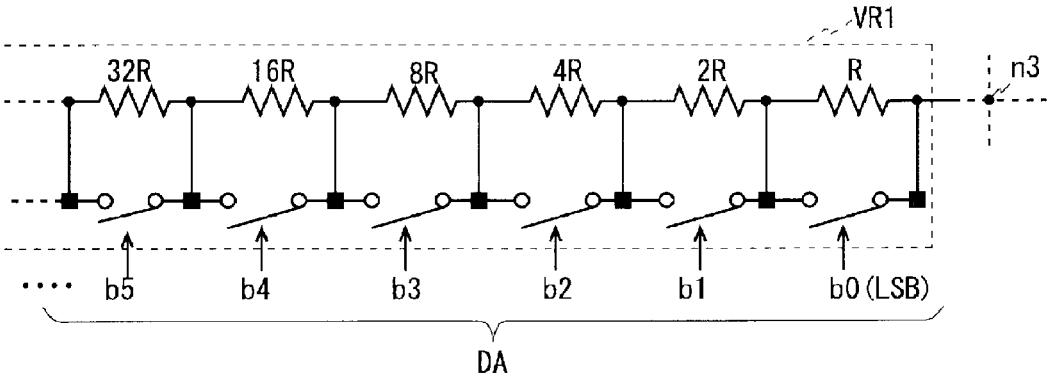
FIG. 8 is a view illustrating a detailed configuration of a variable resistance circuit VR1 according to Embodiment 4.

FIG. 8 is view illustrating a detailed configuration of the variable resistance circuit VR1. The variable resistance circuit VR1 illustrated in FIG. 8 is provided with switches corresponding to bits b0 (LSB) to b7 (MSB) that configure the video data DA formed in this case by 8-bit digital data. The switches are provided so that, when switched on, the two ends of the corresponding resistors are short-circuited. The resistors are set so that values of 2 to the power of k (where k is natural number not higher than 7) in correspondence with the bit values are generated. Thus, when the bit value corresponding to the video data DA is 1, the corresponding switch is turned ON. Conversely, when the corresponding bit value is 0, the corresponding switch is OFF. Hence, the larger the value of the video data, the smaller the value of resistance becomes. This means that as the gradation value becomes larger, the load seen at the node n3 is reduced and the writing time to the data line Sj can be shortened.

Moreover, since the voltage detected by the variable resistance circuit VR1 can be set to be substantially constant (except for changes introduced due to variations in the characteristics of the driving transistor T2), the voltage at the node n3 can be set to substantially constant. As a result, in place of the driving voltage Vdt input to the inverting input terminal of the operational amplifier OP2 that functions as the operation circuit, it is possible to input a driving voltage Vdt0, which is a fixed voltage calculated in advance that may be an ideal value or average value based on the threshold voltage and mobility of transistor T2 or the like. Being a fixed voltage, this voltage will not be a voltage signal having large amplitude in the manner of the driving voltage Vdt, and power consumption can therefore be kept low.

4.2 Modification Example 1 of Embodiment 4

Figure 9:
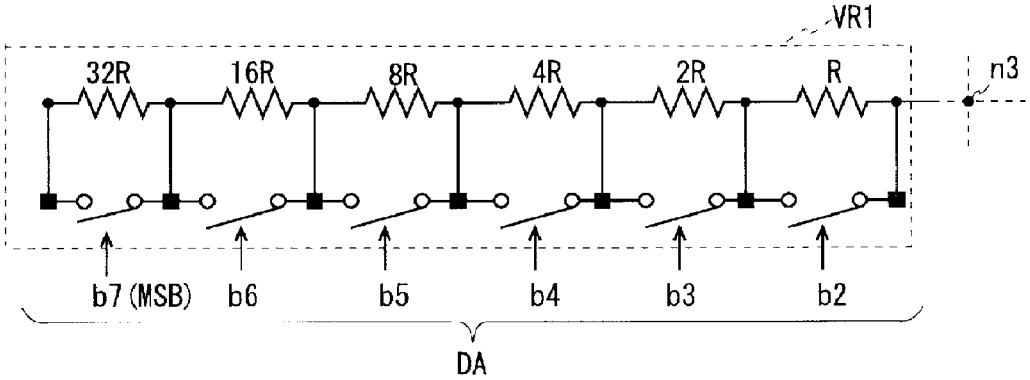
FIG. 9 is a view illustrating a detailed configuration of another variable resistance circuit VR1 according to Modification Example 1 of Embodiment 4.

FIG. 9 is view illustrating a detailed configuration of another example of the variable resistance circuit VR1. The variable resistance circuit VR1 shown in FIG. 9 is provided with similar resistances and switches to the variable resistance circuit VR1 shown in FIG. 8, but differs from the variable resistance circuit VR1 in FIG. 8 in that the lower order bits b0 and b1 of the video data DA are not supplied, and so the switches corresponding to these bits have been omitted. Hence, the modification differs from the above-described Embodiment 4 in that it is not possible to set the voltage detected by the variable resistance circuit VR1 to be substantially constant. However, the detection voltage is substantially equal to a voltage corresponding to the lower order bits of the video data DA (except for changes introduced as a result of variations in the characteristics of the driving transistor T2). As a result, in place of the driving voltage Vdt input to the inverting input terminal of the operational amplifier OP2 that functions as the operation circuit, it is possible to input a driving voltage Vdt0 calculated in advance, which is a voltage corresponding to the lower order bits (3 voltages constituted from 2 bits here) and may be an ideal value or average value based on the threshold voltage and mobility of transistor T2 or the like. Although not a fixed voltage, this voltage will not change to a voltage signal having large amplitude in the manner of the driving voltage Vdt, and power consumption can therefore be kept low. Further, the number of resistors that configures the variable resistance circuit VR1 can be reduced. Moreover, as with the above-described embodiment, the larger the value of the video data, the smaller the value of resistance becomes. This means that as the gradation value becomes larger, the load seen at the node n3 is reduced and the writing time to the data line Sj can be shortened.

4.3 Modification Example 2 of Embodiment 4

As was described above, the detection/output circuit 322 of Embodiment 2 shown in FIG. 4 has substantially the same configuration as the detection/output circuit 321 of Embodiment 1, but differs in that the resistor R1 functioning as the current detecting circuit included in the detection/output circuit 321 is replaced with a transistor T6 that functions as a current detecting circuit in the same way. Thus, by changing the gate potential of the transistor T6, it is possible to set the resistance value with relative freedom. Hence, by applying this resistance value as the value for the resistors included in the variable resistance circuit VR1, it is possible to achieve similar operations to the operations of the Embodiment 4 and the Modification Example 1 of Embodiment 4.

Specifically, a set voltage Vref to be supplied to the gate terminal in order to obtain a resistance value corresponding to all bits of the video data DA or to a prescribed range of the upper order bits is measured in advance, and correspondences between the video data DA and the above-described set voltages Vref are stored in the form of a look-up table or the like. Thus, it is possible, through consultation of the look-up table to realize similar operation to Embodiment 4 and the Modification Example 1 of Embodiment 4 with a simpler configuration.

5. Other

The present invention is not limited to the above-described embodiments and various modifications are possible without departing form the scope of the present invention. For example, the Modification Example of Embodiment 1 may be applied to as a Modification Example in other embodiments, and the configuration of Embodiment 3, and the Modification Example of the same may be employed in Embodiment 2 or Embodiment 4.

Further, in the above-described embodiments, the supply of the driving current Ioled to the organic EL element EL may be controlled by adjusting the potential at the second conducting terminal (such as the source terminal in Embodiment 1 or the drain terminal in the Modification Example of Embodiment 1) of the transistor T2 without using the transistor T4.

Note that in the present specification, electro-optic device is used to mean not only the organic EL element but all devices with optical characteristics that vary according to the supplied electrical power, including field emission displays (FEDs), LEDs, charge driving elements, liquid crystals and electronic ink (e-ink). Further, although the organic EL element was given as an example of the electro-optic device, a similar explanation would apply to all display devices in which light emission is controlled by the amount of current flowing.

INDUSTRIAL APPLICABILITY

The present invention is applicable to a data line driving circuit, and a display device including the same. More specifically, the present invention is applicable to a data line driving circuit for driving a pixel circuit including electro-optic devices such as organic EL elements, and an active matrix-type display device including the same.

DESCRIPTION OF REFERENCE CHARACTERS

1 organic EL display device
10 display unit
11 pixel circuit
20 control circuit
30 source driver (data line driving circuit)
32 detection/output unit
40 gate driver (scan line driving circuit)
321 to 324 detection/output circuit
S1 to Sm data line
G1 to Gn scan line
E1 to En emission control line
T1 to T6 transistor
EL organic EL element
C1, C2, Cf capacitor
OP1 to O3 operational amplifier
CP1, CP2 comparator
Vp power supply voltage
RMP ramp signal
Vcom common potential

What is claimed is:

1. A data line driving circuit configured to be included in an active matrix-type display device having a plurality of pixel circuits arranged in a matrix, the data line driving circuit comprising:

a driving signal generating circuit that receives from outside an image signal representing an image to be displayed, and outputs a driving signal corresponding to said image signal;

an output circuit configured to be connected, via a connection node, to a data line connected to at least one of said plurality of pixel circuits in the active matrix-type display device so as to drive said data line;

a current detecting and controlling circuit configured to be connected to said data line via said connection node, the current detecting and controlling circuit detecting a current flowing in said data line, and comparing said detected current in said data line with a target value that is determined in accordance with said driving signal, the current detecting and controlling circuit receiving a ramp signal having a voltage monotonically increasing from a minimum possible value for the driving signal to a maximum possible value for the driving signal, and supplying said ramp signal to said output circuit until a substantial match is found in said comparison so that said ramp signal is provided to said data line from the output circuit until then, said current detecting and controlling circuit maintaining a voltage of said ramp signal that was reached when the substantial match is found in said comparison and supplying said maintained voltage of said ramp signal to the output circuit so that said maintained voltage is provided to said data line.

2. The data line driving circuit according to claim 1, wherein said current detecting and controlling circuit includes:

a current detection circuit configured to be connected to said data line via said connection node, the current detection circuit having an output node opposite to said connection node such that a potential difference between the output node and the connection node corresponds to said current flowing in said data line;

an operation circuit that receives a voltage value at said output node and an inverse of a voltage value representing the driving signal, and outputs a difference value of said two values;

a comparing circuit that compares said difference value that is output from said operation circuit with a voltage value at said connection node; and a switch circuit that makes an electrical connection such that, until a substantial match is found between the two voltage values being compared by said comparing circuit, said ramp signal is supplied to said output circuit.

3. The data line driving circuit according to claim 1, wherein said current detecting and controlling circuit includes:

a current detection circuit configured to be connected to said data line via said connection node, the current detection circuit having an output node opposite to said connection node such that a potential difference between the output node and the connection node corresponds to said current flowing in said data line;

an operation circuit that receives a voltage value at said connection node and a voltage value representing the driving signal, and outputs a difference value of said two values;

a comparing circuit that compares a voltage value at said output node of said current detection circuit with said difference value that is output from said operation circuit; and a switch circuit that makes an electrical connection such that, until a substantial match is found between the two voltage values compared by said comparing circuit, said ramp signal is supplied to said output circuit.

4. The data line driving circuit according to claim 1, wherein said output circuit includes an operational amplifier that receives said ramp signal supplied by the current detecting and controlling circuit at a non-inverting input terminal of the operational amplifier, wherein said current detecting and controlling circuit includes a current detection circuit that comprises a resistor with one end thereof connected to an inverting input terminal of said operational amplifier of the output circuit and the other end connected to an output terminal of said operational amplifier, and wherein said operational amplifier and said resistor form a transimpedance circuit.

5. The data line driving circuit according to claim 1, wherein said current detecting and controlling circuit includes a variable resistance circuit that receives a portion or all of bits of a digital signal representing said driving signal so as to set a resistance thereof in accordance therewith, and wherein said current detecting and controlling circuit compares a potential difference across said variable resistance circuit with a predetermined reference voltage in the case that the variable resistance circuit receives all of bits of the digital signal or with a reference voltage that is set within a predetermined range in accordance with remaining bits of the digital signal in the case that the variable resistance circuit receives the portion of bits of the digital signal, so as to compare said detected current with said target value determined by said driving signal, and supplies said ramp signal to said output circuit until a substantial match is found in said comparison.

6. The data line driving circuit according to claim 5, wherein said variable resistance circuit receives a prescribed range of high-order bits forming the portion of said digital signal representing said driving signal to set the resistance thereof in accordance with said high-order bit data, and wherein said current detecting and controlling circuit receives low-order bit data that form a remaining portion of bits of said digital signal, and sets the reference voltage in accordance with said low-order bit data of said digital signal, the current detecting and controlling circuit comparing the reference voltage with said potential difference across the variable resistance circuit, so as to compare said detected current in said data line with said target value determined by said driving signal, and supplies said ramp signal to said output circuit until a substantial match is found in said comparison.

7. The data line driving circuit according to claim 1, wherein said current detecting and controlling circuit includes a transistor circuit comprising a transistor operating in a linear region, one end of the transistor circuit being a drain terminal, the other end being a source terminal, and a set voltage that is a predetermined value or that is variable within a predetermined range being supplied to a gate terminal.

8. The data line driving circuit according to claim 7, wherein said transistor circuit receives a portion or all of bits of a digital signal representing said driving signal, and said set voltage to be supplied to said gate terminal is determined in accordance with said portion of or all bits of said digital signal so that a resistance of the transistor between said drain terminal and the source terminal depends on said portion or all of bits of the digital signal, the transistor circuit thereby functioning as a variable resistance circuit, and wherein said current detecting and controlling circuit comparing a potential difference across the transistor circuit with a predetermined reference voltage in the case that the transistor circuit receives all of bits of the digital signal or with a reference voltage that is set in accordance with remaining bits of the digital signal in the case that the transistor circuit receives the portion of bits of the digital signal, and supplies said ramp signal to said output circuit until a substantial match is found in said comparison.

9. An active-matrix type display device, comprising:

a display unit that includes a plurality of data lines, a plurality of scan lines, and a plurality of pixel circuits arranged in correspondence with said plurality of data lines and said plurality of scan lines;

the data line driving circuit according to claim 1 connected to said plurality of data lines; and scan line driving circuits connected to said plurality of scan lines, wherein said pixel circuit includes an electro-optic element driven by an electric current and a driving transistor that is provided in series with said electro-optic element and controls a driving current to be supplied to said electro-optic element in accordance with a voltage supplied via said data line.

10. The display device according to claim 9, wherein said driving transistor is a thin-film transistor having a channel layer formed by an oxide semiconductor, and wherein said oxide semiconductor has indium, gallium, and zinc as main components.

11. A method of driving a data line provided for an active matrix-type display device having a plurality of pixel circuits arranged in a matrix, the method comprising:

generating a driving signal by receiving from outside an image signal representing an image to be displayed and outputting a driving signal corresponding to said image signal;

outputting, to a data line connected to at least one of said plurality of pixel circuits, a ramp signal having a voltage value monotonically increasing from a minimum possible level for the driving signal to a maximum possible level for the driving signal;

detecting a potential difference corresponding to a current flowing in said data line;

comparing a voltage value corresponding to the detected potential difference with a voltage value of said driving signal; and allowing said ramp signal to continue to be outputted to said data line in the step of outputting until a substantial match is found in the step of comparing, and when the substantial match is found in the step of comparing, maintaining a voltage of said ramp signal that was reached when the substantial match is found, and outputting said maintained voltage to said data line instead of said ramp signal thereafter.

* * * * *